US005927879A

United States Patent [19]

Aoyama

[11] Patent Number: 5,927,879

[45] Date of Patent: Jul. 27, 1999

[54] MEDIUM PROCESSING APPARATUS AND EJECTED MEDIUM DROP PREVENTION MECHANISM

[75] Inventor: Noboru Aoyama, Sagamihara, Japan

[73] Assignee: International Business Machines Corporation, Armonk, N.Y.

[21] Appl. No.: 09/151,499

[22] Filed: Sep. 11, 1998

[30] Foreign Application Priority Data

Dec. 5, 1997 [JP] Japan ..... 9-335619

[51] Int. Cl.[6] ..... B41J 11/62

[52] U.S. Cl. ..... 400/717; 400/718; 235/7 R

[58] Field of Search ..... 400/717, 718, 400/613, 613.2, 613.3, 613.4, 611; 226/102, 193; 235/7 R

[56] References Cited

U.S. PATENT DOCUMENTS

| | | | |
|---|---|---|---|
| 4,589,505 | 5/1986 | Takahashi | 177/2 |
| 5,238,316 | 8/1993 | Moore et al. | 400/613.2 |
| 5,302,811 | 4/1994 | Fukatsu | 235/381 |
| 5,489,773 | 2/1996 | Kumar | 235/462 |
| 5,642,951 | 7/1997 | Belizario | 400/613.2 |
| 5,779,379 | 7/1998 | Mason et al. | 400/621 |

FOREIGN PATENT DOCUMENTS 9-335619 12/1997 Japan .

*Primary Examiner*—Ren Yan
*Assistant Examiner*—Minh H. Chau
*Attorney, Agent, or Firm*—John D. Flynn

[57] ABSTRACT

After the medium has been processed by the medium processing apparatus 100 (receipt journal printer), it lands on the top cover 120 of the medium processing apparatus 100 as a curled medium 160. The ejected medium drop prevention mechanism 110 is disposed at the point where the edge of the ejected medium lands. The ejected medium drop prevention mechanism 110 has a ladder like structure and holds the edge of the ejected medium by introducing the edge into the opening of the ladder like structure, thereby preventing the ejected medium from dropping down.

30 Claims, 6 Drawing Sheets

MEDIUM PROCESSING APPARATUS AND EJECTED MEDIUM DROP PREVENTION MECHANISM

TECHNICAL FIELD

This invention relates to a system for holding a medium ejected from a medium processing apparatus and, particularly, to an improved ejected medium drop prevention mechanism.

BACKGROUND

A receipt journal printer of a Point-of-Sale (POS) prints on rolled paper and cuts the printed paper (a medium such as paper ejected from a medium processing apparatus such as a printer is hereinafter called "ejected medium" regardless of whether it is printed or not) using a cutter.

When the ejected medium, outputted from a printer, is short in length, it stays on a top cover of the printer without dropping down to the back of the printer. However, when the ejected medium is very long as shown in FIG. 11, it drops down to the back of the printer.

An account statement printed in a receipt journal printer of POS at the end of daily business is often as long as 50 cm and drops down to the back of the printer when the ejected medium is cut upon completion of printing. Because the account statement printed at the end of daily business takes a long time to print, it was desired that it was printed without operator attendance, but it had to be watched by an operator to prevent the medium from dropping down to the back of the housing of the printer.

Relating to such a problem of the eject mechanism of a printer, PUPA4-226776 discloses, in its first embodiment, a provision of a forward eject guide in the medium eject exit so as to have the ejected medium drop in the front of the printer housing to prevent it from dropping to the back of the printer. Also, the second embodiment of the same PUPA discloses a provision of a medium take-up guide in the medium eject exit so as to take up the medium to prevent it from dropping to the back of the printer.

However, because such guide is of a structure protruding from the housing of a printer, use entails the following drawbacks:

1. It hinders exchanges with customers when giving change or receiving money.
2. It can be easily damaged.
3. An item cannot be put on the printer (especially when the printer is in operation).
4. The ejected medium curls toward the printed surface to make the printed content invisible or unreadable.
5. The appearance design of printer is largely restricted.
6. The ejected medium drops to the front and may be stained in the forward eject guide. It is not easy to take out the ejected medium in the medium take up guide.

SUMMARY OF THE INVENTION

It is an object of this invention to provide a medium processing apparatus in which an ejected medium does not drop even when a long medium is ejected.

It is another object of this invention to provide an ejected medium drop prevention mechanism while maintaining a characteristic of user friendly medium processing apparatus without hindering working the exchange of items with the customer.

It is another object of this invention to provide an ejected medium drop prevention mechanism which has a low probability of being damaged.

It is a further object of this invention to provide an ejected medium drop prevention mechanism which does not hinder observation of the printed surface of the ejected medium.

It is a further object of this invention to provide an ejected medium drop prevention mechanism which is less restrictive in designing the appearance of the printer.

It is a further object of this invention to provide a user friendly ejected medium drop prevention mechanism which allows the ejected medium to be simply taken up without requiring any special operation.

In accordance with an embodiment of the present invention, an ejected medium drop prevention mechanism is disposed at a point where the medium touches a top cover, etc., of a medium processing apparatus with the medium curled after it is processed by the medium processing apparatus. The ejected medium drop prevention mechanism is provided with an opening leading to an internal space in the side of eject exit for allowing the edge of the ejected medium to enter the opening. The opening holds the edge of the ejected medium to prevent the ejected medium from dropping down.

In another embodiment of this invention, a medium processing apparatus is provided which ejects a curled medium after processing and cuts off said ejected medium after the process ends. The apparatus has a cutter for cutting off said ejected medium, a top cover, and an ejected medium drop prevention mechanism disposed at a position where the edge of said ejected medium lands on said top cover and provided with a plurality of bars forming a ladder like shape which is disposed so as to provide a space between the bars and said top cover.

In another embodiment of this invention, a medium processing apparatus is provided which ejects a curled medium after processing and cuts off said ejected medium after the process ends. The apparatus has a cutter for cutting off said ejected medium, a top cover, and an ejected medium drop prevention mechanism disposed at a position where the edge of said ejected medium lands on said top cover and provided with an opening having a space into which the edge of the ejected medium move along the direction of the curl.

In another embodiment of this invention, a medium processing apparatus is provided which can process a medium of different lengths and ejects a curled medium after processing. The apparatus has an ejected medium drop prevention mechanism disposed at a position where the edge of said ejected medium lands and provided with an opening having a space into which the edge of the ejected medium moves along the direction of the curl.

In another embodiment of this invention, provided is an ejected medium drop prevention mechanism disposed at a position where the edge of said ejected medium lands on said top cover of a medium processing apparatus which ejects a curled medium after processing and cuts off said ejected medium after the process ends, said mechanism is provided with a plurality of bars forming a ladder like shape which is disposed so as to provide a space between the bars and said top cover.

In another embodiment of this invention, provided is an ejected medium drop prevention mechanism disposed at a position where the edge of said ejected medium lands on a medium processing apparatus which can process a medium of different lengths and ejects a curled medium after processing, said mechanism is provided with a plurality of openings having a space into which the edge of the ejected medium move along the direction of the curl.

BRIEF DESCRIPTION OF THE DRAWINGS

The foregoing and other objects, aspects, and advantages of the invention will be better understood from the following detailed description with reference to the drawings, in which.

Figure 1:
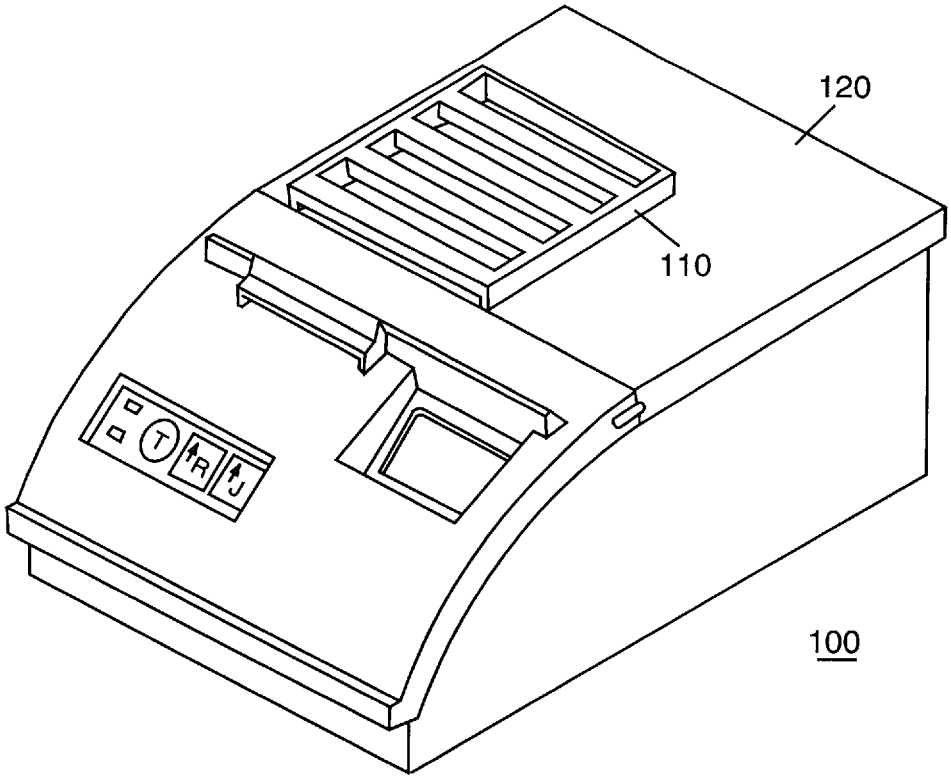
FIG. 1 shows the appearance of a medium processing apparatus of a preferred embodiment of this invention.

| Description of Reference Numbers in the Drawings | |
|---|---|
| 100: | medium processing apparatus |
| 110: | ejected medium drop prevention mechanism |
| 120: | top cover |
| 131–137: | bar |
| 160: | ejected medium |
| 170: | rolled medium |
| 171–177: | opening of the elected medium drop prevention mechanism |
| 180: | platen |
| 181: | print head |
| 153: | cutter |
| 185: | eject exit |

DETAILED DESCRIPTION

The term "medium processing apparatus" is defined as a concept embracing various printers including a receipt journal printer. The term "ejected medium" is described as an object to be operated upon or work piece, and is not an element of this invention.

Figure 2:
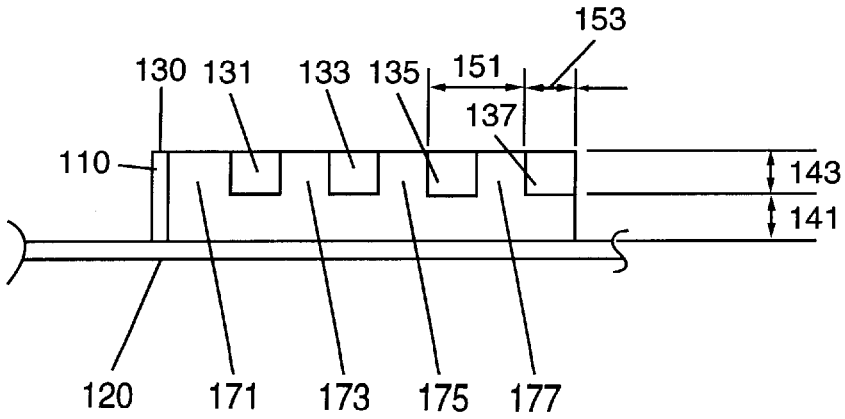
FIG. 2 is a cross sectional view of an ejected medium drop prevention mechanism of a preferred embodiment of this invention.

FIG. 1 shows the appearance of an embodiment of a printer 100 of this invention. FIG. 2 is a cross sectional view of an ejected medium drop prevention mechanism 110 provided in the printer 100.

The ejected medium drop prevention mechanism 110 in a preferred embodiment of this invention has a ladder like structure and is disposed at a point where a receipt is landed. In this example, the ejected medium drop prevention mechanism 110 is formed by modifying the top cover 120 of IBM 4689-301 Receipt Journal Printer and, specifically, is integrally formed by molding a resin. While the ejected medium drop prevention mechanism 110 is formed by molding a resin in the preferred embodiment of this invention, it may be formed of a sheet metal as well.

In the example shown in FIG. 1 and FIG. 2, bars 131 through 137 are of a square cross section of 8 mm by 8 mm and are disposed in a position 7 mm above the cover surface of the printer. The pitch 151 of the bars is designed to be 20 mm (the length of the openings 171 through 177 is therefore designed to be 12 mm).

If the length of the opening is too long, sufficient frictional force is not obtained to hold an ejected medium. On the other hand, if the length is to short, the end of the ejected medium may not enter the opening due to twist of the ejected medium, etc., and the medium may be curled on the bar. Accordingly, it is desirable to set the length of the opening to about 13 to 28 mm when this invention is applied to the roll paper for a POS printer. Also, the width of the opening is designed to be sufficiently wider than the ejected medium taking a lateral shift of the ejected medium into consideration.

Similarly, if the space between the bars 131 through 137 and the cover surface is too wide, a sufficient frictional force is not obtained to hold the ejected medium. On the other hand, if the space is too narrow, the end of the medium may be caught by the bar due to curling and twisting of the ejected medium inhibiting the end of the medium from moving into the space beneath the bars. Therefore, it is desirable to set the space between the bars and the cover surface to about 3 to 15 mm when this invention is applied to the roll paper for a POS printer.

On the other hand, a ladder like structure is adopted in the ejected medium drop prevention because the paper tends to curl differently depending on the diameter of the rolled paper (large at the beginning of use and small at the end of use) resulting in different landing points of the ejected paper.

Figure 3:
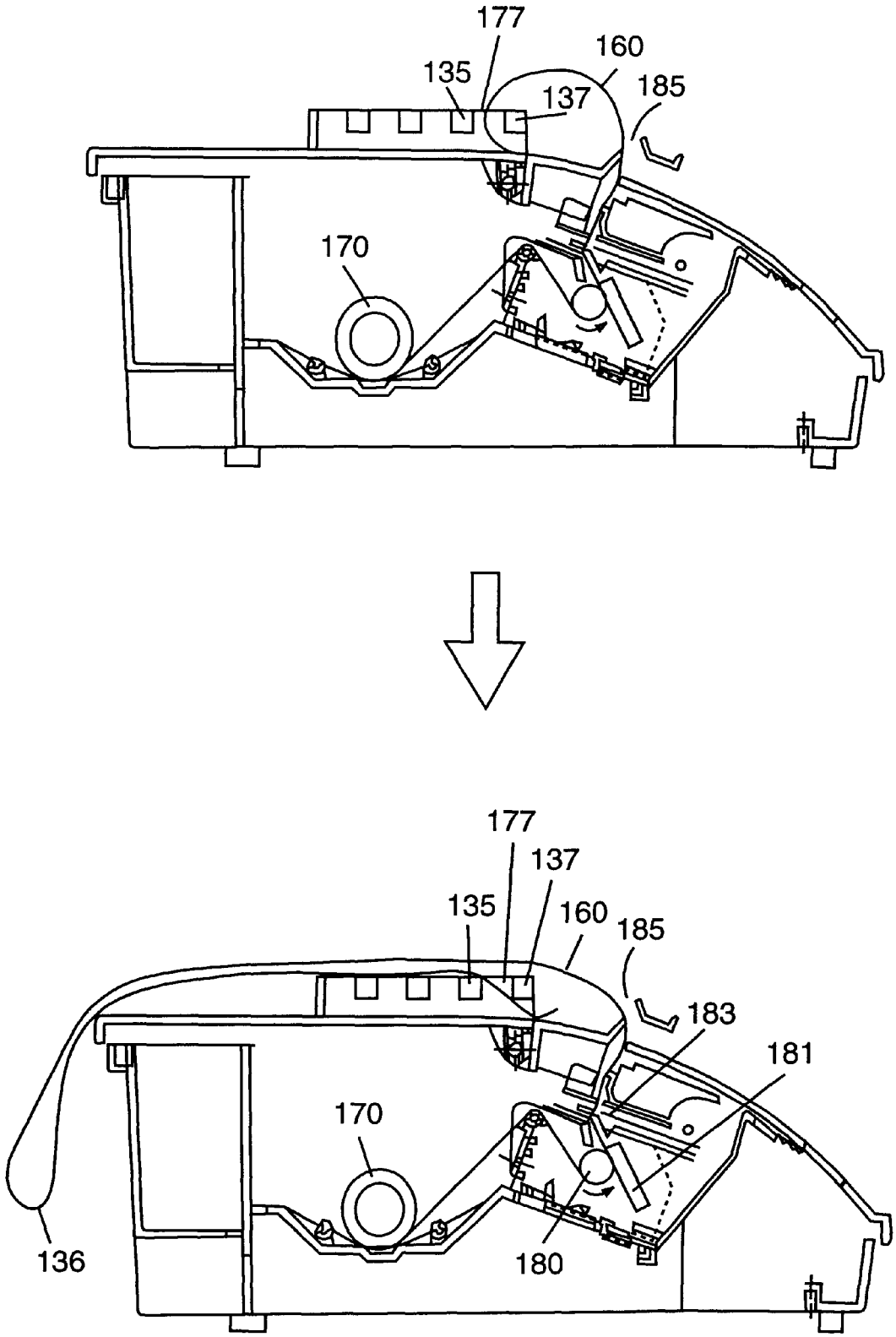
FIG. 3 is a cross sectional view of the medium processing apparatus of a preferred embodiment of this invention.
Figure 4:
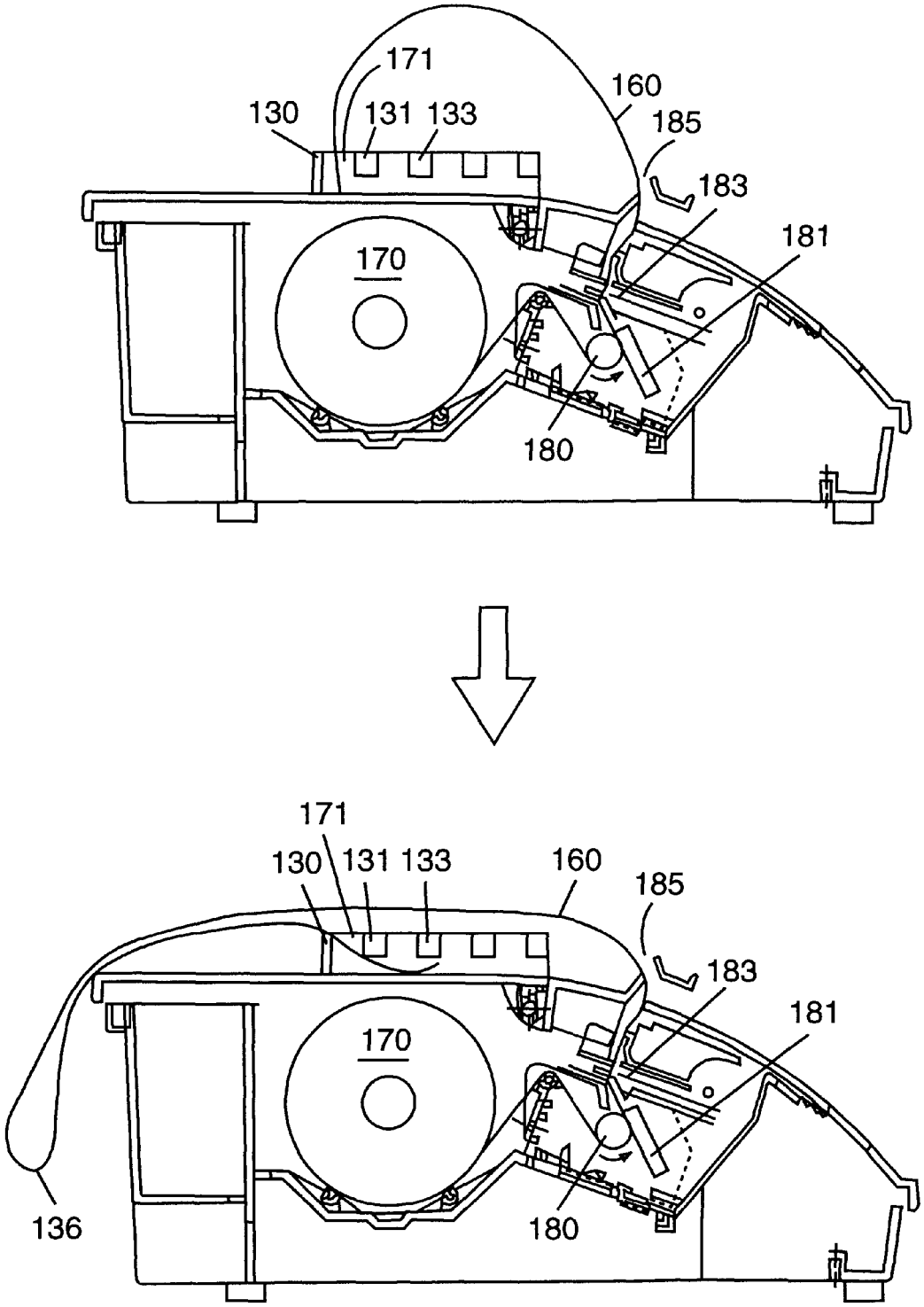
FIG. 4 is a cross sectional view of the medium processing apparatus of a preferred embodiment of this invention.

FIG. 3 shows the case of a minimum curl while FIG. 4 shows the case of a maximum curl. In a typical roll paper for a POS printer, outer diameter of the roll is 80 mm at the beginning of use while it is 20 mm at the end of the roll.

According to the result of an experiment using IBM 4689-301 Receipt Journal Printer, the radius of curl was 41 mm and the distance of landing from the exit was 109 mm at the beginning of use. When the roll paper is almost ending, the radius of curl was 20 mm and the distance of landing from the exit was 46 mm. Accordingly, the opening 171 which is furthest from the eject exit is disposed at a position somehow further from the maximum landing point while the opening 177 which is nearest the eject exit is disposed at a position somehow nearer the minimum landing point.

Because the optimum values of the shape and the position of the ejected medium drop prevention mechanism vary depending on the structure of a platen (radius, etc.), feed speed, printing impact pressure, properties of the ejected medium (material, thickness, width, etc.), temperature, humidity, angle of ejection, angle between the eject exit and the cover, and positional relationship there between, it is desirable to take these factors into consideration.

Figure 5:
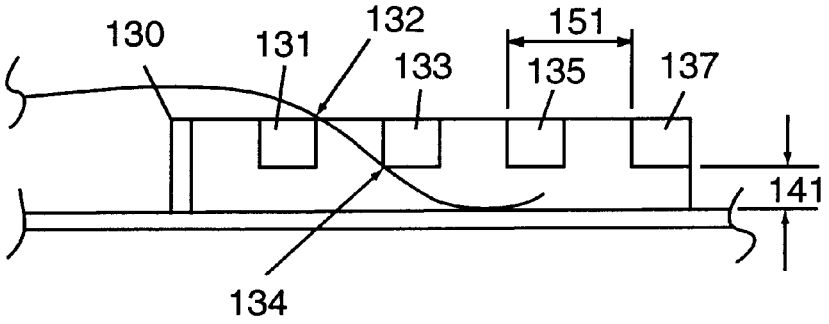
FIG. 5 is a cross sectional view of an ejected medium drop prevention mechanism of a preferred embodiment of this invention.
Figure 11:
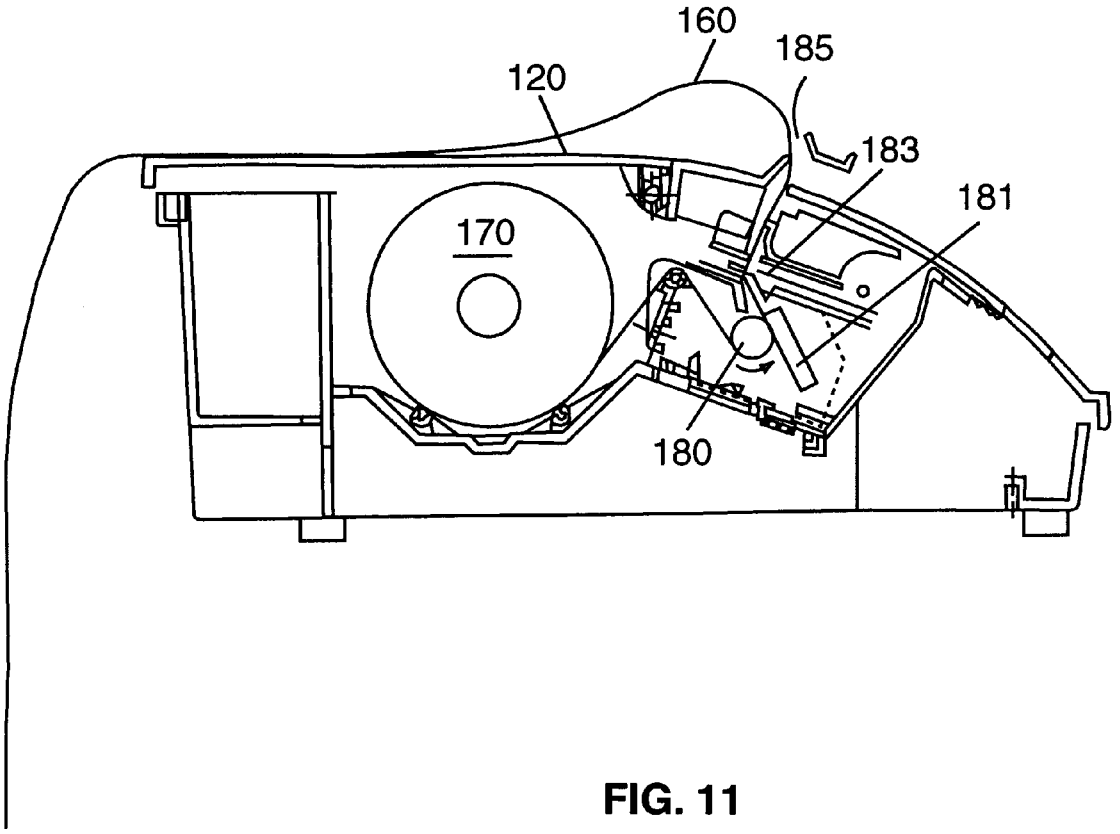
FIG. 11 is a cross sectional view of a prior art medium processing apparatus.

The process in which the ejected medium drop prevention mechanism holds the ejected medium is next explained in the sequence of operations with reference to FIG. 3 to FIG. 5. As shown in FIG. 3, when the ejected medium 160 is progressively fed out from the eject exit 185 of the medium processing apparatus 100, the leading edge of the ejected medium 160 drops into either one of the openings 171 through 177 which are formed by the bars 131 through 137 (even if the leading edge of the ejected medium lands on a bar, the edge drops without fail into the space between the bars by a progressive feeding of the ejected medium because the openings 171 through 177 of the ejected medium drop prevention mechanism 110 are designed taking twist or lateral shift of the edge of the ejected medium into consideration).

Thereafter, as the ejected paper is fed out, the outer surface of the curled paper (the printing surface in this example) touches the bar 135 which is positioned after the opening (opening 177 in the example of FIG. 3) into which the edge of the ejected medium 160 drops and the edge is prevented from moving toward the rear of the printer. As the ejected paper is further fed out, the leading edge moves toward the front of the printer conversely until the inner surface of the curled paper (back of the printing surface in this case) contacts to the bar 133 (the edge of the ejected paper moves into the space beneath the bar 137 which lies inside the curl).

When the ejected paper is further fed out after the inner surface of the curled paper touches the bar 133, a moment and a stress are generated around the corner 132 of the bar 131 by virtue of the resilience of the ejected paper (generated by stretching the curl) and the weight of the paper. The stress is also generated at the corner 134. As a result, a sufficient frictional force is generated at the corners 132 and 134 to prevent the ejected paper from dropping.

Figure 6:
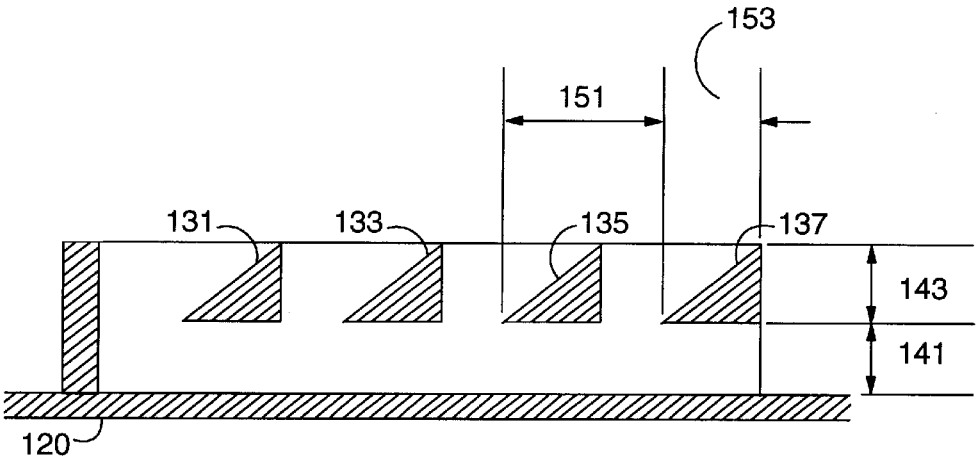
FIG. 6 is a cross sectional view of an ejected medium drop prevention mechanism of a preferred embodiment of this invention.

As such, the receipt is held without dropping down as shown in FIG. 5 and FIG. 6 even if the ejected medium is cut after the folding part 136 of the ejected medium has moved to the rear of the cover 120 of the printer. Thus, the operator can simply take the receipt by taking it up as it is.

Figure 7:
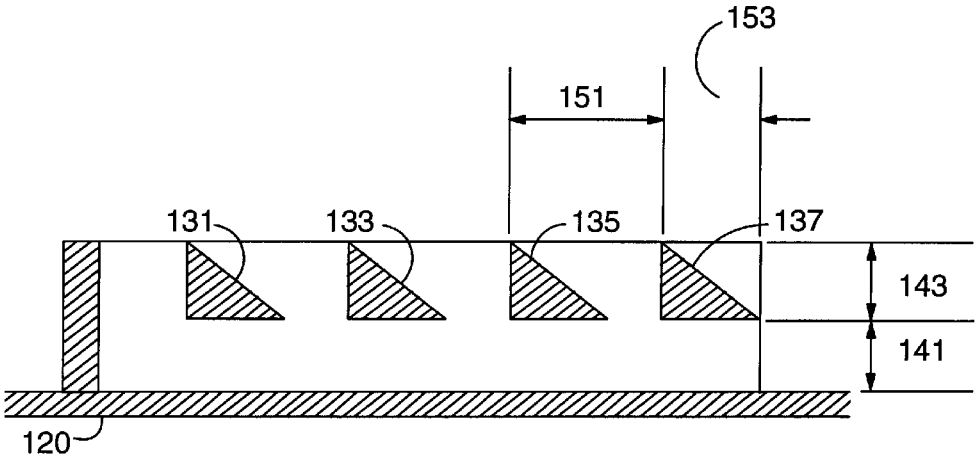
FIG. 7 is a cross sectional view of an ejected medium drop prevention mechanism of a preferred embodiment of this invention.

FIG. 6 to FIG. 9 show alternative embodiments of this invention. FIG. 6 and FIG. 7 show an example in which the shape of the bars 131 through 137 are so modified as to make the edge of the ejected medium 160 more easily enter the openings 171 through 177. While the bars 131 through 137 have a triangular cross section, they may have other cross section such as a parabolic or a circular cross section.

Incidentally, in the example of FIG. 7, the ejected medium 160 once having entered the openings 171–177 may slide up the triangular slope of the bars 131–137 so that the embodiment of FIG. 6 is preferable.

Figure 8:
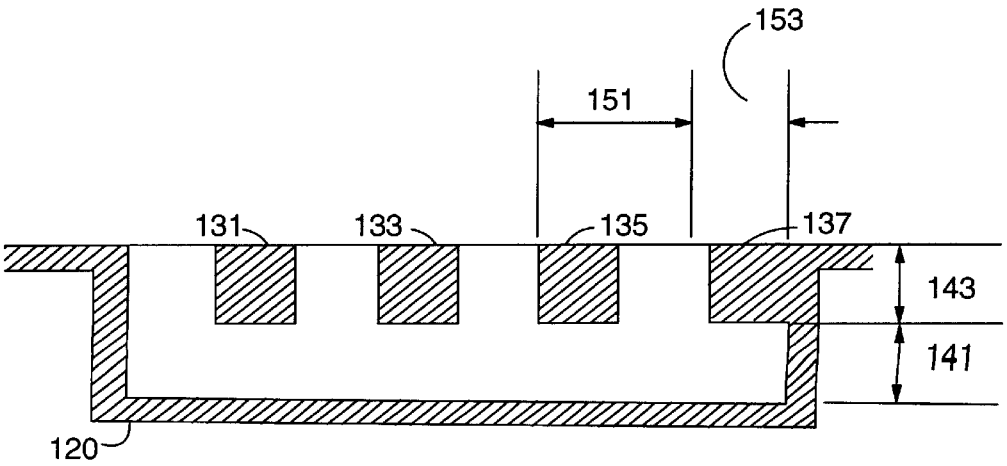
FIG. 8 is a cross sectional view of an ejected medium drop prevention mechanism of a preferred embodiment of this invention.

FIG. 8 shows an example in which the ejected medium drop prevention mechanism 110 is embedded in the top cover 120. With this embodiment the top surface of the medium processing apparatus 100 is open for other use because the ejected medium drop prevention mechanism 110 does not protrude from the top cover 120. The ladder frame including the bars may be made detachable so that dust inside the ejected medium drop prevention mechanism 110 may be easily cleaned off.

Figure 9:
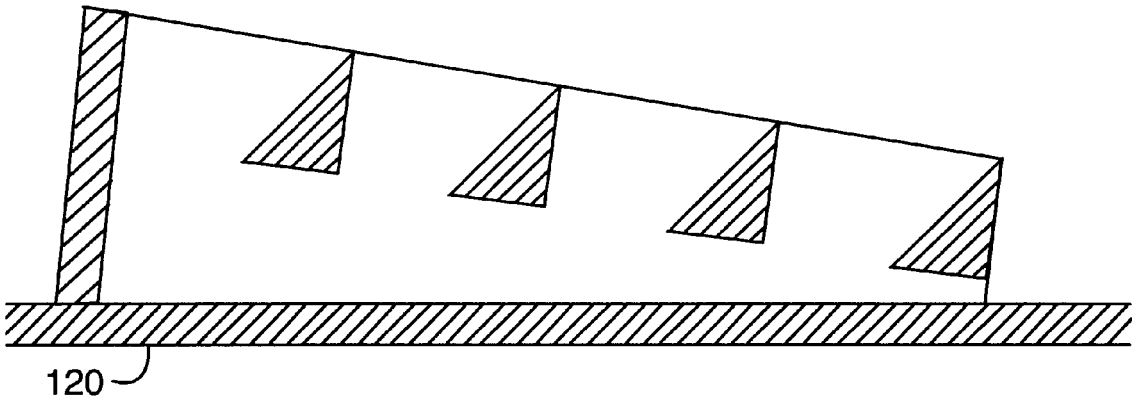
FIG. 9 is a cross sectional view of an ejected medium drop prevention mechanism of a preferred embodiment of this invention.

FIG. 9 shows an example which is designed taking different radii of the curl at different landing positions into consideration. While the edge of the ejected paper 160 arriving at the proximity of the eject exit 185 can move into the space beneath the bar 137 even though the space between the bar 137 and the top cover 120 is narrow because the radius of the curl is small, the edge of the ejected paper 160 arriving at a position further from the eject exit 185 can not move into the space beneath the bar 137 if the space between the bar 137 and the top cover 120 is narrow because the radius of the curl is large.

On the other hand, when the radius of the curl is small, a narrower spacing between the bar and the top cover 120 gives a higher holding force to the ejected medium 160 than the case where the radius of the curl is large. As such, it is so designed that the space between the bar and the top cover 120 is narrow near the eject exit 185 while it is wider in positions further from the eject exit 185.

Figure 10:
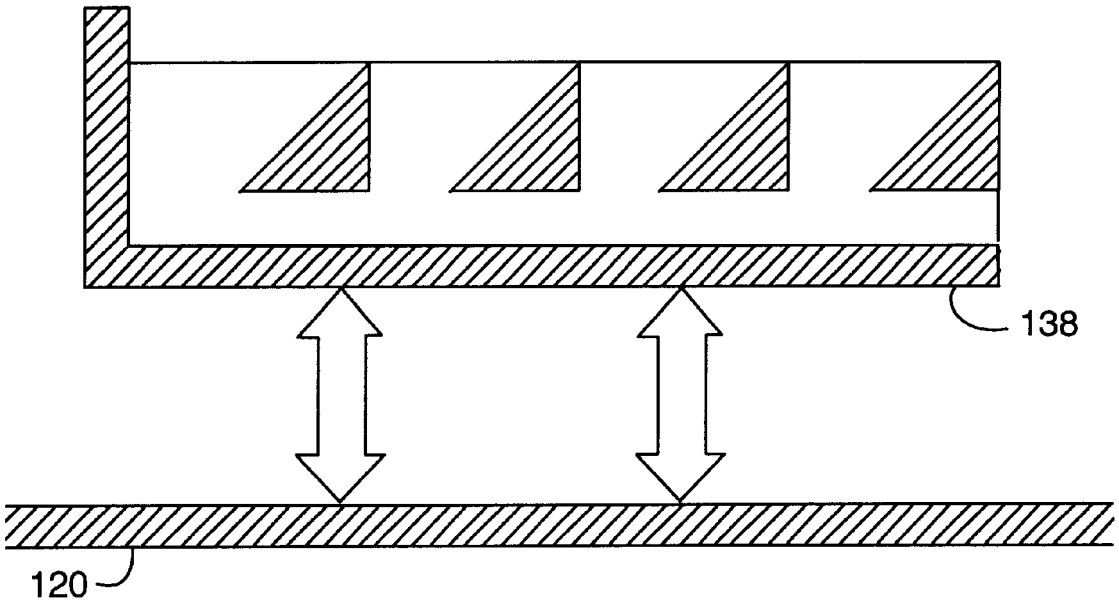
FIG. 10 is a cross sectional view of an ejected medium drop prevention mechanism of a preferred embodiment of this invention.

FIG. 10 shows an example in which the ejected medium drop prevention mechanism 110 is detachable from the top cover 120. In the example shown, a magnet is embedded in the bottom 138 of the ejected medium drop prevention mechanism 110 so that it is attached to the top cover 120 (a magnetically attractive material such as a steel sheet is used on the surface of or inside the top cover 120 in this example). Conversely, the top cover 120 may include a magnet.

In the preferred embodiment of this invention, a position where the ejected medium drop prevention mechanism 110 is to be set is marked on the top cover 120. However, in order to prevent the edge of the ejected paper 160 landing furthest from the eject exit 185 from passing over the wall 130 of the ejected medium drop prevention mechanism 110 even when a user sets the mechanism 110 somehow out of the right position, the wall 130 is so designed that it is taller than the bars 131–137 as shown in FIG. 10.

While the ejected medium drop prevention mechanism 110 is made detachable from the top cover 120 by means of a magnet in this example, other means may be used to make it detachable, including a sucking disk, velcro, a screw as well as a slide mechanism (a groove is provided in one of the mechanism 110 and the top cover 120 and the other is provided with a protrusion engaging with the groove) and a latch mechanism or a combination thereof.

As described in the above, this invention provides a user friendly ejected medium drop prevention mechanism which has an advantage in that:

1. it does not hinder working;
2. it has a low probability of being damaged;
3. it does not hinder observation of the printed surface of the ejected medium;
4. appearance design is less restricted;
5. the ejected medium can be simply taken up without requiring a special operation.

While the invention has been described in terms of preferred embodiments, those skilled in the art will recognize that the invention can be practiced with modification within the spirit and scope of the appended claims.

I claim:

1. A medium processing apparatus which ejects a curled medium after processing and cuts off said ejected medium after the process ends, said apparatus comprising:

(a) a cutter for cutting off said ejected medium, (b) a top cover, and (c) an ejected medium drop prevention mechanism disposed at a position where the edge of said ejected medium lands on said top cover and provided with a plurality of bars forming a ladder like shape which is disposed so as to provide a space between the bars and said top cover.

2. An ejected medium drop prevention mechanism disposed at a position where the edge of said ejected medium lands on a top cover of a medium processing apparatus which ejects a curled medium after processing and cuts off said ejected medium after the process ends, said mechanism is provided with a plurality of bars forming a ladder like shape which is disposed so as to provide a space between the bars and said top cover.

3. The medium processing apparatus according to claim 1 wherein the bars form a plurality of openings for receiving the edge of the ejected medium into the space between the bars and the top cover.

4. The medium processing apparatus according to claim 3 wherein the bars have a triangular cross section.

5. The medium processing apparatus according to claim 3 wherein the bars have a circular cross section.

6. The medium processing apparatus according to claim 3 wherein the bars have a parabolic cross section.

7. The medium processing apparatus according to claim 3 wherein the bars have a rectangular cross section.

8. The medium processing apparatus according to claim 3 wherein the pitch of bars is about 20 mm.

9. The medium processing apparatus according to claim 3 wherein the length of the openings are each between 13 to 28 mm.

10. The medium processing apparatus according to claim 9 wherein the space between the bars and the top cover is between 3 to 15 mm.

11. The medium processing apparatus according to claim 10 wherein the bars have a triangular cross section.

12. The medium processing apparatus according to claim 11 wherein the space between the bars and the top cover is narrower at one end of the ladder like shape.

13. The medium processing apparatus according to claim 3 wherein the space between the bars and the top cover is between 3 to 15 mm.

14. The medium processing apparatus according to claim 3 wherein the ejected medium drop prevention mechanism is embedded in the top cover.

15. The medium processing apparatus according to claim 3 wherein the ejected medium drop prevention mechanism is detachable from the top cover.

16. The medium processing apparatus according to claim 3 wherein the space between plurality of bars forming the ladder like shape is parallel to the top cover.

17. The medium processing apparatus according to claim 3 wherein the space between the bars and the top cover is narrower at one end of the ladder like shape.

18. An ejected medium drop prevention mechanism adapted for use at a position where the edge of said ejected medium lands on a top cover of a medium processing apparatus which ejects a curled medium after processing and cuts off said ejected medium after the processing ends, said ejected medium drop prevention mechanism comprising:

a plurality of bars forming a ladder like shape which is disposed so as to provide a space between the bars and a surface, the bars form a plurality of openings for receiving the edge of an ejected medium into the space between the bars and the surface.

19. The ejected medium drop prevention mechanism according to claim 18 wherein the bars have a triangular cross section.

20. The ejected medium drop prevention mechanism according to claim 18 wherein the bars have a circular cross section.

21. The ejected medium drop prevention mechanism according to claim 18 wherein the bars have a parabolic cross section.

22. The ejected medium drop prevention mechanism according to claim 18 wherein the bars have a rectangular cross section.

23. The ejected medium drop prevention mechanism according to claim 18 wherein the pitch of bars is about 20 mm.

24. The ejected medium drop prevention mechanism according to claim 18 wherein the length of the openings are each between 13 to 28 mm.

25. The ejected medium drop prevention mechanism according to claim 24 wherein the space between the bars and the surface is between 3 to 15 mm.

26. The ejected medium drop prevention mechanism according to claim 25 wherein the bars have a triangular cross section.

27. The ejected medium drop prevention mechanism according to claim 26 wherein the space between the bars and the surface is narrower at one end of the ladder like shape.

28. The ejected medium drop prevention mechanism according to claim 18 wherein the space between the bars and the surface is between 3 to 15 mm.

29. The ejected medium drop prevention mechanism according to claim 18 wherein the space between plurality of bars forming the ladder like shape is parallel to the surface.

30. The ejected medium drop prevention mechanism according to claim 18 wherein the space between the bars and the surface is narrower at one end of the ladder like shape.

* * * * *